US010321521B2

(12) United States Patent
Anton Falcon et al.

(10) Patent No.: US 10,321,521 B2
(45) Date of Patent: Jun. 11, 2019

(54) HOB APPARATUS

(71) Applicant: BSH Hausgeräte GmbH, Munich (DE)

(72) Inventors: Daniel Anton Falcon, Saragossa (ES); Ignacio Garde Aranda, Saragossa (ES); Oscar Gracia Campos, Saragossa (ES); Ignacio Millan Serrano, Saragossa (ES); Daniel Palacios Tomas, Saragossa (ES); Oscar Pallares Zaera, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 356 days.

(21) Appl. No.: 15/105,688

(22) PCT Filed: Dec. 17, 2014

(86) PCT No.: PCT/IB2014/067014
§ 371 (c)(1),
(2) Date: Jun. 17, 2016

(87) PCT Pub. No.: WO2015/092704
PCT Pub. Date: Jun. 25, 2015

(65) Prior Publication Data

US 2016/0323937 A1 Nov. 3, 2016

(30) Foreign Application Priority Data

Dec. 20, 2013 (ES) ..... 201331877

(51) Int. Cl.
*H05B 6/04* (2006.01)
*H05B 6/06* (2006.01)
*H05B 6/12* (2006.01)

(52) U.S. Cl.
CPC ..... *H05B 6/065* (2013.01); *H05B 6/04* (2013.01); *H05B 6/062* (2013.01)

(58) Field of Classification Search
CPC ..... H05B 6/04; H05B 6/062; H05B 6/065
(Continued)

(56) References Cited

U.S. PATENT DOCUMENTS

2009/0139980 A1 6/2009 Acero Acero et al.
2011/0226756 A1* 9/2011 Arnal Valero ..... H05B 6/065 219/622

(Continued)

FOREIGN PATENT DOCUMENTS

DE 102013207786 A1 12/2013
EP 2515608 A2 * 10/2012 ..... H05B 6/065

(Continued)

OTHER PUBLICATIONS

International Search Report PCT/IB2014/067014 dated Apr. 10, 2015.
National Search Report ES P201331877 dated Dec. 20, 2013.

*Primary Examiner* — Hung D Nguyen
(74) *Attorney, Agent, or Firm* — Michael E. Tschupp; Andre Pallapies; Brandon G. Braun

(57) ABSTRACT

A hob apparatus includes a configuration unit having at least two input connections for connection to at least two inverters in one-to-one correspondence, at least two output connections for connection to at least two heating elements in one-to-one correspondence, and at least one switch operably connected to a first one of the at least two input connections and operably connected to at least a first one of the at least two output connections. The configuration unit operates the at least two inverters in at least one operating state in parallel to at least one of the at least two heating elements. The configuration unit includes at least one bridging element to connect the first one of the at least two input connections and a second one of the at least two output connections to one another independently of a switching position of the at least one switch.

20 Claims, 8 Drawing Sheets

(58) Field of Classification Search
USPC ..... 219/395, 443.1, 447.1, 462.1, 620, 622, 219/624, 660, 661, 662, 671, 672, 675
See application file for complete search history.

(56) References Cited

U.S. PATENT DOCUMENTS

| | | | | |
|---|---|---|---|---|
| 2012/0205365 | A1* | 8/2012 | Anton Falcon | H05B 6/065 219/620 |
| 2012/0318786 | A1* | 12/2012 | Casanova Lacueva | H05B 6/062 219/447.1 |

FOREIGN PATENT DOCUMENTS

| | | | |
|---|---|---|---|
| JP | 2006107897 | A | 4/2006 |
| JP | 2009158225 | A | 7/2009 |
| SU | 1278989 | A1 | 12/1986 |
| WO | 2010069883 | A1 | 6/2010 |

* cited by examiner

HOB APPARATUS

CROSS-REFERENCES TO RELATED APPLICATIONS

This application is the U.S. National Stage of International Application No. PCT/IB2014/067014, filed Dec. 17, 2014, which designated the United States and has been published as International Publication No. WO 2015/092704 and which claims the priority of Spanish Patent Application, Serial No. P201331877, filed Dec. 20, 2013, pursuant to 35 U.S.C. 119(a)-(d).

BACKGROUND OF THE INVENTION

The invention proceeds from a hob apparatus.

A hob apparatus which comprises a configuration unit and is designed as an induction hob apparatus is already known from the prior art. The configuration unit has two input connections which are each intended to form a connection to at least one heating frequency unit. Furthermore the configuration unit has two output connections which are each intended to form a connection to a plurality of heating elements. In each case a switch of the configuration unit is disposed between a first of the input connections and a first of the output connections as well as between a second of the input connections and a second of the output connections. The switches are intended to switch the two heating frequency units in parallel.

BRIEF SUMMARY OF THE INVENTION

The object of the invention consists in particular in providing a generic apparatus having improved properties in respect of high efficiency. The object is achieved by the features of the invention.

The invention proceeds from a hob apparatus, in particular an induction hob apparatus, having at least one configuration unit which has at least two input connections which are each intended to form a connection to at least one inverter, at least two output connections which are each intended to form a connection to at least one heating element, and at least one switch which is connected to a first input connection of the at least two input connections and at least to a first output connection of the at least two output connections, and which is intended to operate the at least two inverters in at least one operating state, in particular in at least one boost mode, in parallel to at least one of the at least two heating elements.

It is proposed that the at least one configuration unit has at least one bridging element which is intended to connect the first input connection and a second output connection of the at least two output connections to one another independently of a switching position of the at least one switch. A "hob apparatus" should be understood in particular to mean at least one part, in particular a subassembly, of a hob, in particular of an induction hob. In particular the hob apparatus can also comprise the entire hob, in particular the entire induction hob. A "configuration unit" should be understood in particular to mean a unit which is intended to assume different switching positions in at least two operating states different from one another. The at least one configuration unit has in particular at least one control contact which is advantageously intended to receive control signals generated in particular by a control unit and via which in particular in at least one operating state a switching position of the at least one configuration unit can be changed. An "inverter" should be understood in particular to mean an electrical unit which generates an oscillating electrical signal, preferably having a frequency of at least 1 kHz, in particular of at least 10 kHz, advantageously of at least 20 kHz and in particular of a maximum of 100 kHz for at least one heating element. In particular the inverter is intended to provide a maximum electrical output, required by the at least one heating element, of at least 100 W, in particular at least 500 W, advantageously at least 1000 W and preferably at least 1500 W. In this case the hob apparatus comprises in particular the at least two inverters. The phrase stating that a first object "is intended to form a connection to a second object" should be understood in particular to mean that in at least one operating state an electrically conductive connection exists between the first object and the second object, advantageously independently of at least one switching unit in the in particular electrically conductive connection, which in particular is disposed between the first object and the second object. A "heating element" should be understood in particular to mean an element which is intended in at least one operating state for an in particular inductive heating of a cooking container, in particular having a maximum heat output of at least 100 W, in particular of at least 500 W, preferably of at least 1000 W and particularly advantageously of at least 1500 W. In this case the hob apparatus comprises in particular the at least two heating elements, wherein the hob apparatus advantageously has a total of at least four, in particular at least six, advantageously at least eight and particularly advantageously a plurality of heating elements. A "switch" should be understood in particular to mean an element which is intended to establish and/or break an electrically conductive connection between at least two points, in particular contacts of the switch. In this case the switch is designed in particular as an electrical element and preferably has at least one control contact for receipt of a control signal, wherein the switch can be actuated via the control contact and in particular can be switched between the at least two contacts, in particular as a function of a control signal generated by a control unit. The phrase stating that a first object is "connected" to a second object should be understood in particular to mean that at least one operating state exists in which the first object and the second object are in contact with one another by means of an electrically conductive connection, wherein in particular in the at least one operating state electrical current flows between the first object and the second object via the electrically conductive connection. The phrase stating that the at least one configuration unit is intended to operate the at least two inverters in at least one operating state "in parallel to at least one of the at least two heating elements" should be understood in particular to mean that the at least one configuration unit is intended, in the at least one operating state, to connect the at least two inverters, in particular by changing a switching position of the at least one switch, simultaneously to the at least one heating element, and in particular to transfer energy generated by the at least two inverters simultaneously to the at least one heating element, in particular in order to achieve a high and advantageously higher output power of the at least one heating element. In this case the configuration unit comprises in particular an electrical connection between the second input connection and the first output connection, which in particular can be electrically switched. A "bridging element" should be understood in particular to mean an electrically conductive element which is intended to connect at least two contact points in particular directly electrically conductively to one another at least in an assembled state, in particular independently of an operating state and advantageously independently of switching positions of any switching units and/or of any switches. Different embodiments of the at least one bridging element which appear as expedient to a person skilled in the art are conceivable. For example, the at least one bridging element can be designed as a permanent connection between the at least two contact points, wherein the at least one bridging element in particular could be disposed fixedly on at least one circuit board. Likewise conceivable is that the at least one bridging element can be designed to be removable, wherein the at least one bridging element in particular enables different topologies and/or arrangements on the at least one circuit board. "Intended" should be understood in particular to mean specifically programmed, designed and/or configured. The statement that an object is intended for a specific function should be understood in particular to mean that the object fulfills and/or performs this particular function in at least one application state and/or operating state.

Thanks to the inventive embodiment it is possible in particular to achieve a high degree of efficiency, advantageously a high degree of electrical and/or in particular a high degree of economic efficiency. A high output power can advantageously be achieved, in particular since the at least one configuration unit is intended for high electrical currents. Because of the at least one bridging element a small electrical current through the switch can advantageously be achieved, as a result of which in particular a switch with low requirements and/or with a small size can be used. As a result, low costs can preferably be achieved.

The at least one switch could for example be connected exclusively to the first output connection, wherein exactly one electrical connection could exist between the first input connection and the second output connection, which in particular would be formed by the at least one bridging element. Preferably the at least one switch is however additionally connected to the second output connection, wherein in particular a "normally closed" contact of the at least one switch is connected to the second output connection. Alternatively it is conceivable for a "normally opened" contact of the at least one switch to be connected to the second output connection. This means that in particular a high degree of flexibility can be achieved.

For example the at least one bridging element could be intended to bridge the "normally opened" contact of the at least one switch.

Preferably the at least one bridging element is however intended to bridge a "normally closed" contact of the at least one switch, as a result of which in particular a high output power and/or a high current intensity can be provided at the second output connection.

It is further proposed that the at least one configuration unit has at least one second switch, which is connected to a second input connection of the at least two input connections and at least to the second output connection, as a result of which in particular a high degree of flexibility can be achieved.

For example, the at least one second switch could be connected exclusively to the second output connection, wherein advantageously exactly the one in particular switchable electrical connection could exist between the second input connection and the first output connection. Preferably the at least one second switch is however additionally connected to the first output connection, wherein the at least one second switch could form the one in particular switchable electrical connection. Various connection options of the at least one second switch to the first output connection are conceivable which appear expedient to a person skilled in the art. For example, a "normally opened" contact of the at least one switch could be connected to the first output connection. Advantageously however a "normally closed" contact of the at least one switch is connected to the first output connection. As a result further switches can in particular be dispensed with, as a result of which low costs can advantageously be achieved.

Furthermore it is proposed that the at least one configuration unit has at least one second bridging element which is intended to connect a second input connection of the at least two input connections and the first output connection to one another, as a result of which in particular a high degree of electrical and/or economic efficiency can be achieved.

If the at least one second bridging element is intended to bridge a "normally closed" contact of the at least one second switch, a component with low requirements can in particular be used for the at least one second switch, as a result of which low costs and/or a hob apparatus which can be acquired inexpensively by a customer can be achieved.

Furthermore it is proposed that the hob apparatus comprises a switching unit which is switched between the at least one configuration unit and the at least two heating elements. A "switching unit" should be understood in particular to mean an electronic unit which is intended to establish and/or break an electrically conductive connection at least between two contact points. The switching unit preferably has at least one control contact, via which the switching unit advantageously can be switched in at least one operating state and via which the switching unit receives in particular in at least one operating state at least one control signal, which advantageously is generated by a control unit. The phrase stating that the switching unit is switched "between" the at least one configuration unit and the at least two heating elements should be understood in particular to mean that in each operating state in which the at least two heating elements are fed with electrical current by the configuration unit the electrical current flows through the switching unit. When viewed in the direction of a cable path the switching unit is advantageously switched starting from the configuration unit upstream of the at least two heating elements. As a result in particular a high degree of flexibility can be achieved.

For example, the switching unit could have exactly one further switch which in particular could be intended—advantageously in the case of an incorrect switching position of the configuration unit—to break the connection between the at least one configuration unit and the at least two heating elements and in particular to perform an emergency switch-off. However, the switching unit preferably has at least two further switches which are each intended to connect one of the at least two heating elements individually to the configuration unit, wherein a number of further switches and a number of heating elements is advantageously at least substantially identical. As a result in particular a high degree of operational safety can be achieved.

Further advantages emerge from the following description of the drawing. Exemplary embodiments of the invention are illustrated in the drawing. The drawing, the description and the claims contain numerous features in combination. The person skilled in the art will expediently also consider the features individually and combine them to form meaningful further combinations.

DETAILED DESCRIPTION OF EXEMPLARY EMBODIMENTS OF THE PRESENT INVENTION

Figure 1:
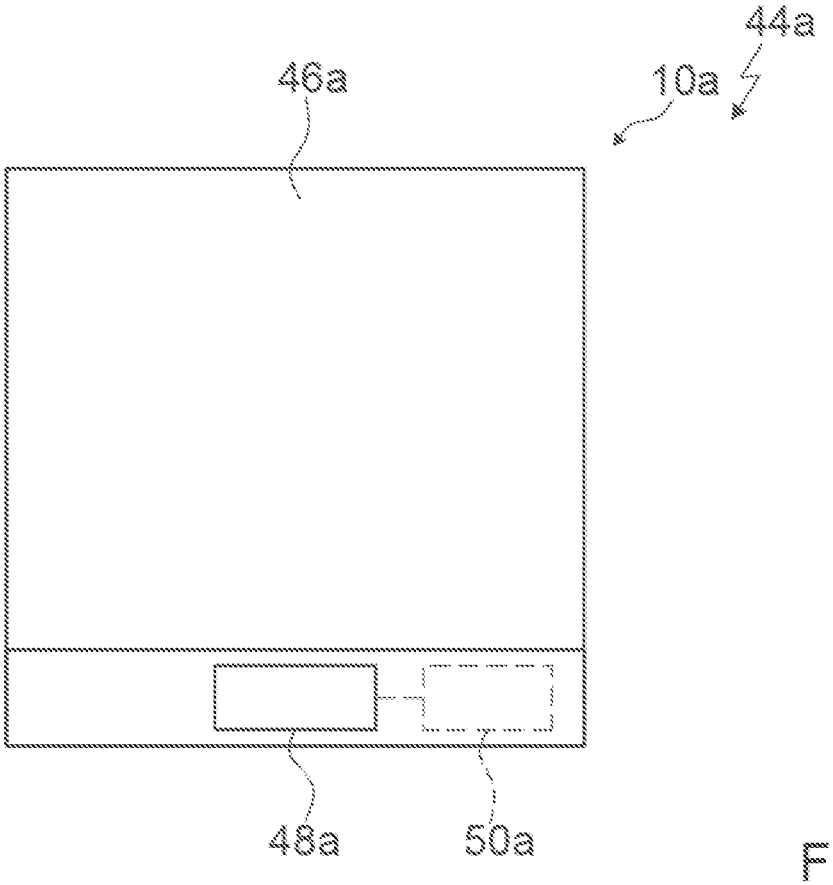
FIG. 1 shows an inventive hob having an inventive hob apparatus in a schematic planar view.

FIG. 1 shows a hob 44*a*, which is designed as an induction hob, having a hob apparatus 10*a* which is designed as an induction hob apparatus. The hob apparatus 10*a* has a hob plate 46*a* on which to place cooking containers. Furthermore the hob apparatus 10*a* comprises a plurality of heating elements 26*a*, 28*a* for heating cooking containers placed thereon (cf. FIG. 2). The heating elements 26*a*, 28*a* are designed as induction heating elements. In a built-in position the heating elements 26*a*, 28*a* are disposed underneath the hob plate 46*a*. In an assembled state the heating elements 26*a*, 28*a* are disposed in the form of a hob matrix. The heating elements 26*a*, 28*a* are disposed in a half-bridge circuit in the assembled state. The heating elements 26*a*, 28*a* are split into two groups. In this case a first group comprises the heating elements 26*a* and a second group comprises the heating elements 28*a*. Alternatively to a hob matrix it is conceivable for the heating elements to be designed as movably mounted heating elements which are intended to be moved underneath the hob plate in directions aligned substantially parallel to the hob plate. Furthermore it is conceivable for the heating elements to form a traditional hob, in which each heating element in particular defines an autonomous, separate heating zone which is advantageously marked on the hob plate.

The hob apparatus 10*a* comprises an operating unit 48*a* for inputting and/or selecting operating parameters, for example a heat output and/or a heat output density and/or a heating zone (cf. FIG. 1). The operating unit 48*a* is intended for the output of a value of an operating parameter to an operator. The hob apparatus 10*a* comprises a control unit 50*a*, which as a function of operating parameters input by means of the operating unit 48*a* performs actions and/or changes settings. In one operating state the control unit 50*a* operates the heating elements 26*a*, 28*a* as a function of operating parameters input by means of the operating unit 48*a*.

Figure 2:
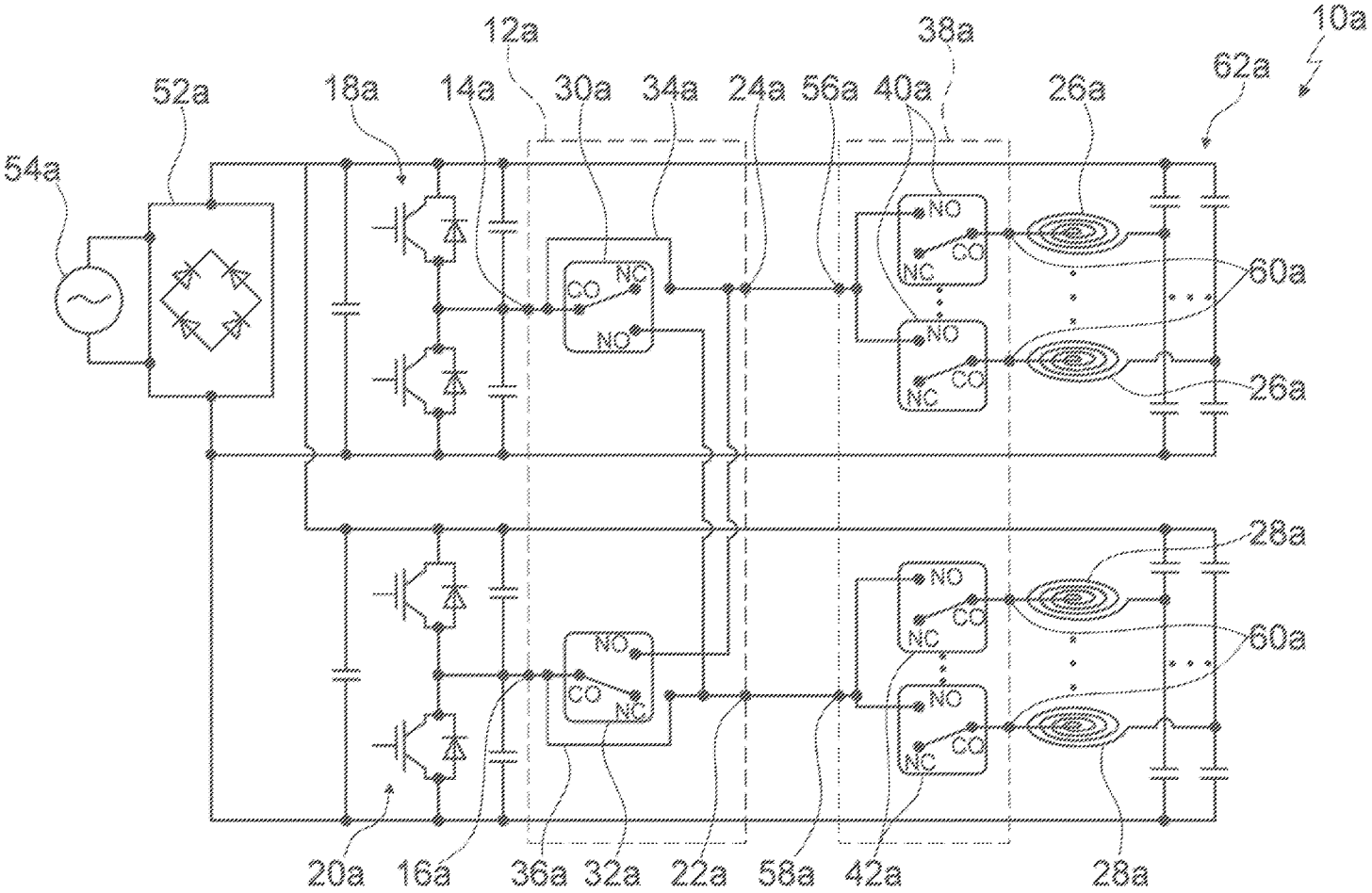
FIG. 2 shows the hob apparatus of the hob in a schematic illustration.

The hob apparatus 10*a* comprises a rectifier 52*a*, which is intended for connection to a phase 54*a* of a domestic power supply (cf. FIG. 2). Furthermore the hob apparatus 10*a* comprises two inverters 18*a*, 20*a*, which are each connected to the rectifier 52*a*. The inverters 18*a*, 20*a* are intended for generating a high-frequency alternating current. By means of the high-frequency alternating current generated by the inverters 18*a*, 20*a* the heating elements 26*a*, 28*a* are supplied in the operating state. As a function of the operating parameters input by means of the operating unit 48*a* the control unit 50*a* actuates the inverters 18*a*, 20*a*.

The inverters 18*a*, 20*a* are designed to be substantially identical, which is why in this section only one of the inverters 18*a*, 20*a* is considered. The inverter 18*a* has two series-connected, bidirectional unipolar switches. The switches are formed by a transistor and a parallel-switched diode. Furthermore the inverter 18*a* has in each case a damping capacitor switched in parallel to the bidirectional unipolar switches. A voltage tap of the inverter 18*a* is disposed at a shared contact point of two bidirectional unipolar switches.

The hob apparatus 10*a* comprises a configuration unit 12*a* which is switched between the inverters 18*a*, 20*a* and the heating elements 26*a*, 28*a*. The configuration unit 12*a* has two input connections 14*a*, 16*a*, which are each intended to form a connection to one of the inverters 18*a*, 20*a*. A first input connection 14*a* of the input connections 14*a*, 16*a* is connected to a first inverter 18*a* of the inverters 18*a*, 20*a*. A second input connection 16*a* of the input connections 14*a*, 16*a* is connected to a second inverter 20*a* of the inverters 18*a*, 20*a*. The configuration unit 12*a* has two output connections 22*a*, 24*a*. A first output connection 22*a* of the output connections 22*a*, 24*a* is intended to form a connection to the heating elements 26*a*. A second output connection 22*a* of the output connections 22*a*, 24*a* is intended to form a connection to the heating elements 28*a*.

Figure 3:
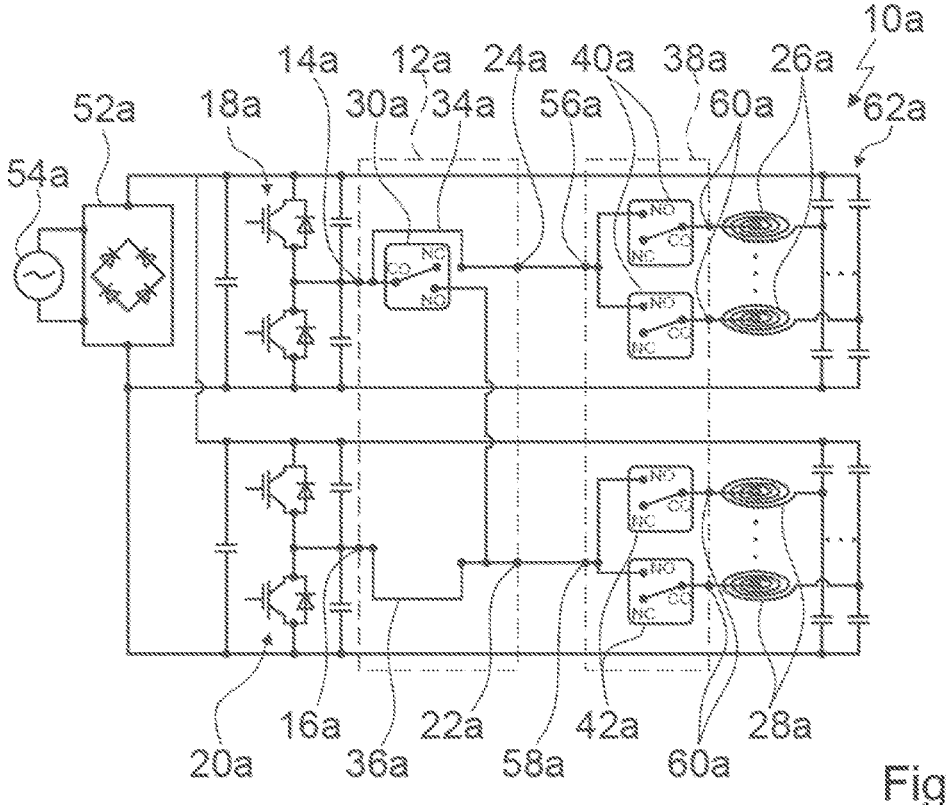
FIG. 3 shows a modified hob apparatus in a schematic illustration.
Figure 4:
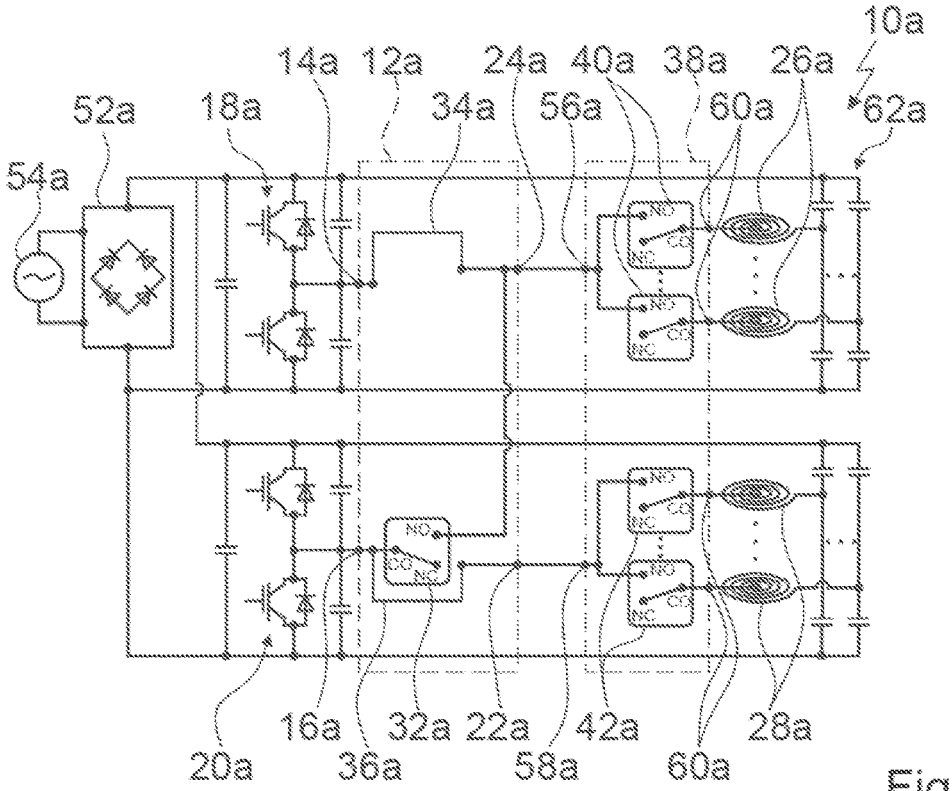
FIG. 4 shows a further modified hob apparatus in a schematic illustration.

The configuration unit 12*a* has a switch 30*a* and a second switch 32*a*. Alternatively to an embodiment of the configuration unit having two switches, an embodiment having exactly one switch is conceivable (cf. FIGS. 3 and 4). The switches 30*a*, 32*a* are designed as changeover switches (cf. FIG. 2). The switches 30*a*, 32*a* are designed as relays. The switch 30*a* is connected to the first input connection 14*a* and the first output connection 22*a*. The switch 30*a* has a "changeover" contact. The "changeover" contact of the switch 30*a* is connected to the first input connection 14*a*. The switch 30*a* has a "normally opened" contact and a "normally closed" contact. The "normally opened" contact of the switch 30*a* is connected to the first output connection 22*a*. The "normally opened" contact of the switch 30*a* is connected to the first output connection 22*a*. A "normally closed" contact of the switch 30*a* is free-standing, in particular connectionless. The second switch 32*a* is connected to the second input connection 16*a* and the second output connection 24*a*. The second switch 32*a* has a "changeover" contact. The "changeover" contact of the second switch 32*a* is connected to the second input connection 16*a*. The second switch 32*a* has a "normally opened" contact and a "normally closed" contact. The "normally opened" contact of the second switch 32*a* is connected to the second output connection 24*a*. The "normally closed" contact of the second switch 32*a* is free-standing, in particular connectionless.

The configuration unit 12*a* has a bridging element 34*a* and a second bridging element 36*a*. The bridging element 34*a* connects the first input connection 14*a* and the second output connection 24*a* to one another independently of a switching position of the switches 30*a*, 32*a*. Independently of a switching position of the switches 30*a*, 32*a* the configuration unit 12*a* has an electrically conductive connection between the first inverter 18*a* and the second output connection 24*a*. The electrically conductive connection between the first inverter 18*a* and the second output connection 24*a* is formed by the first bridging element 34*a*. The second bridging element 36*a* connects the second input connection 16*a* and the first output connection 22*a* to one another independently of a switching position of the switches 30*a*, 32*a*. The configuration unit 12*a* has an electrically conductive connection between the second inverter 20*a* and the first output connection 22*a* independently of a switching position of the switches 30*a*, 32*a*. In this case the electrically conductive connection between the second inverter 20*a* and the first output connection 22*a* is formed by the second bridging element 36*a*.

In the operating state the configuration unit 12*a* is intended to operate the inverters 18*a*, 20*a* in parallel to a group of the heating elements 26*a*, 28*a*. For example, the configuration unit 12*a* could switch a switching position of the switch 30*a* from the "normally closed" contact to the "normally opened" contact, as a result of which the inverters 18*a*, 20*a* are operated in parallel to the heating elements 28*a*. Alternatively the configuration unit 12*a* could switch a switching position of the second switch 32*a* from the "normally closed" contact to the "normally opened" contact, as a result of which the inverters 18*a*, 20*a* are operated in parallel to the heating elements 26*a*. The operating state, in which the inverters 18*a*, 20*a* are operated jointly in parallel to a group of the heating elements 26*a*, 28*a*, is referred to as a boost mode. In a further operating mode it is conceivable for the first group of the heating elements 26*a* to be operated on the second inverter 20*a*. Likewise, in the further operating mode it is possible to operate the second group of the heating elements 28*a* on the first inverter 18*a*.

The hob apparatus 10*a* comprises a switching unit 38*a*, which is switched between the configuration unit 12*a* and the heating elements 26*a*, 28*a*. The switching unit 38*a* has two input connections 56*a*, 58*a*. A first input connection 56*a* of the input connections 56*a*, 58*a* of the switching unit 38*a* is connected to the second output connection 24*a* of the configuration unit 12*a*. A second input connection 58*a* of the input connections 56*a*, 58*a* of the switching unit 38*a* is connected to the first output connection 22*a* of the configuration unit 12*a*. The switching unit 38*a* has a plurality of output connections 60*a*. A number of output connections 60*a* of the switching unit 38*a* is substantially identical to a number of heating elements 26*a*, 28*a*.

The switching unit 38*a* has a plurality of further switches 40*a*, 42*a*, which are each intended to connect one of the heating elements 26*a*, 28*a* individually to the configuration unit 12*a*. The further switches 40*a*, 42*a* are split into two groups. In this case a first group has the further switches 40*a* which are associated with the first group of the heating elements 26*a*. In each case a further switch 40*a* of the first group is connected to a heating element 26*a* of the first group and is intended to connect the respective heating element 26*a* individually to the configuration unit 12*a*. A second group has the further switches 42*a* which are associated with the second group of the heating elements 28*a*. In each case a further switch 42*a* of the second group is connected to a heating element 28*a* of the second group and is intended to connect the respective heating element 28*a* individually to the configuration unit 12*a*.

The hob apparatus 10*a* comprises a plurality of resonance capacitors 62*a*. Each resonance capacitor 62*a* is associated with one of the heating elements 26*a*, 28*a*. A number of resonance capacitors 62*a* is substantially identical to a number of heating elements 26*a*, 28*a*. Alternatively it is conceivable for the hob apparatus to have exactly one resonance capacitor per group of heating elements, wherein the hob apparatus in the present exemplary embodiment could in particular have two resonance capacitors which could each be associated with a group of heating elements. In the present exemplary embodiment each resonance capacitor 62*a* has two capacitors. Alternatively embodiments having a different number of capacitors are conceivable.

FIGS. 5 to 13 show further exemplary embodiments of the invention. The following descriptions are substantially limited to the differences between the exemplary embodiments, wherein in respect of components, features and functions which remain identical reference can be made to the description of the exemplary embodiments in FIGS. 1 to 4. To distinguish the exemplary embodiments the letter a in the reference characters of the exemplary embodiments in FIGS. 1 to 4 is replaced by the letter b in the reference characters of the exemplary embodiments in FIGS. 5 to 13. In respect of identically designated components, in particular in reference to components having identical reference characters, reference can in principle also be made to the drawings and/or the description of the exemplary embodiments in FIGS. 1 to 4.

Figure 5:
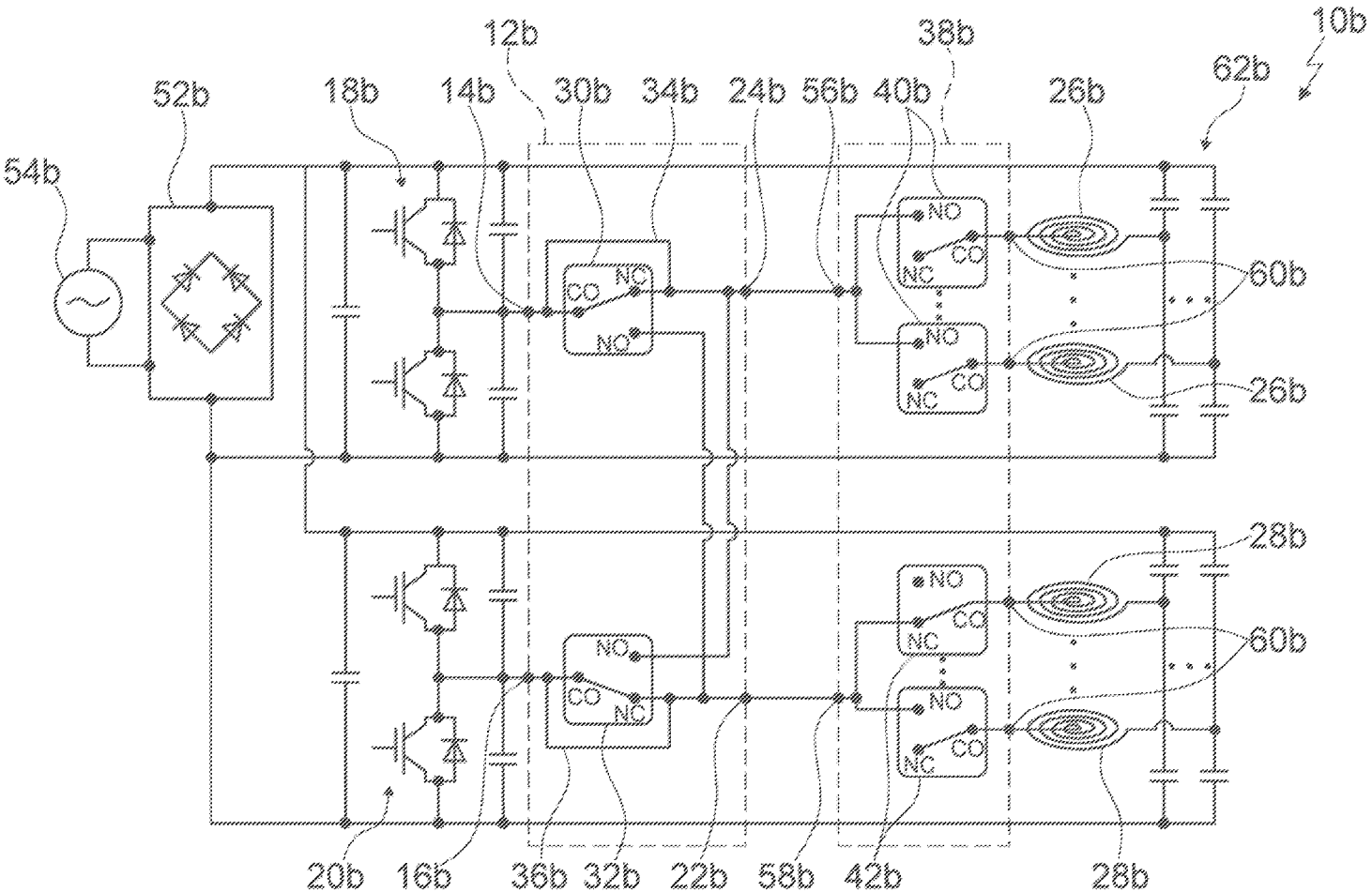
FIG. 5 shows an alternative hob apparatus in a schematic illustration.
Figure 6:
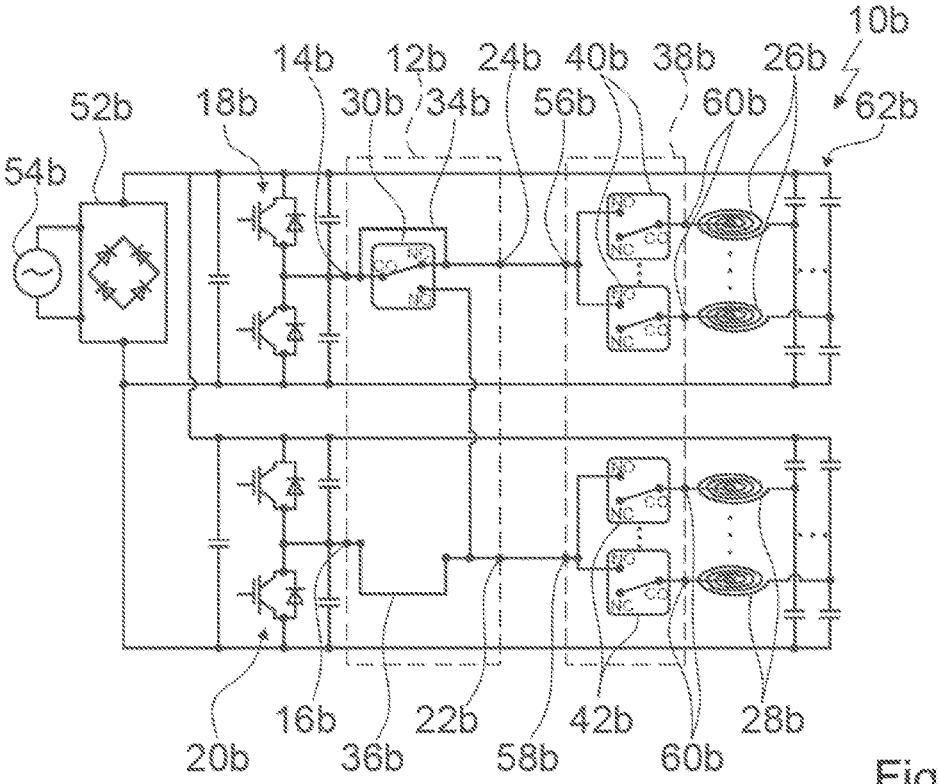
FIG. 6 shows a modified hob apparatus in a schematic illustration.

FIG. 5 shows a hob apparatus 10*b*, which is designed as an induction hob apparatus, of a hob which is designed as an induction hob. The hob apparatus 10*b* comprises a configuration unit 12*b* which has two input connections 14*b*, 16*b*. The input connections 14*b*, 16*b* are each intended to form a connection to an inverter 18*b*, 20*b* of the hob apparatus 10*b*. Furthermore the configuration unit 12*b* has two output connections 22*b*, 24*b*. A first output connection 22*b* of the output connections 22*b*, 24*b* is intended to form a connection to heating elements 26*b* of the hob apparatus 10*b*. A second output connection 22*b* of the output connections 22*b*, 24*b* is intended to form a connection to heating elements 28*b* of the hob apparatus 10*b*.

Figure 7:
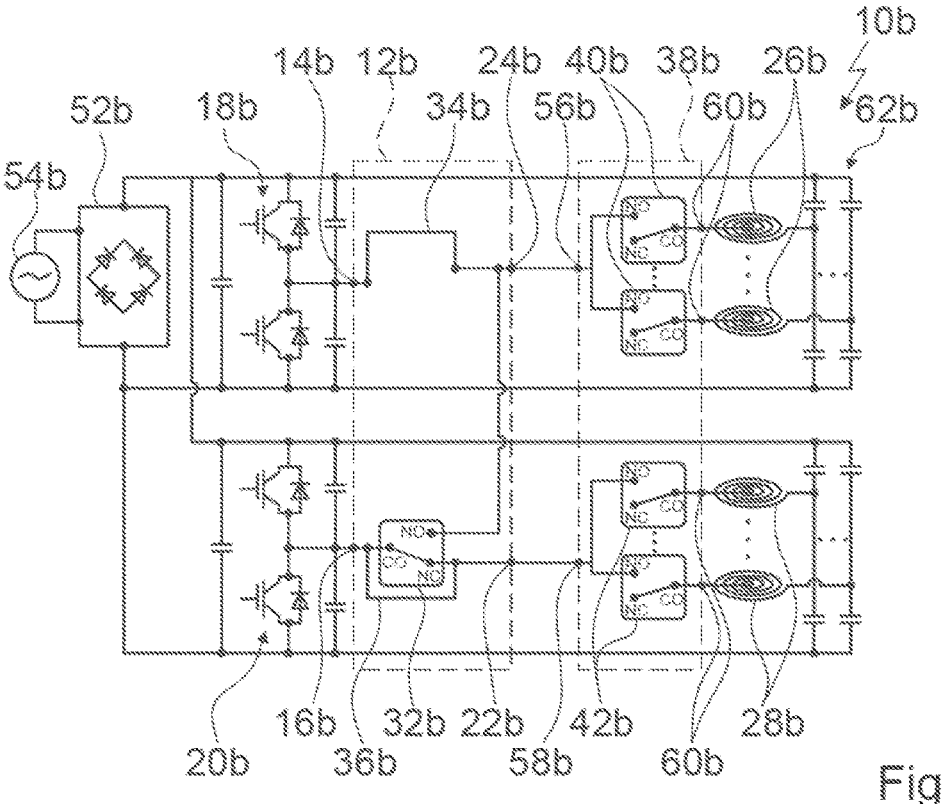
FIG. 7 shows a further modified hob apparatus in a schematic illustration.
Figure 8:
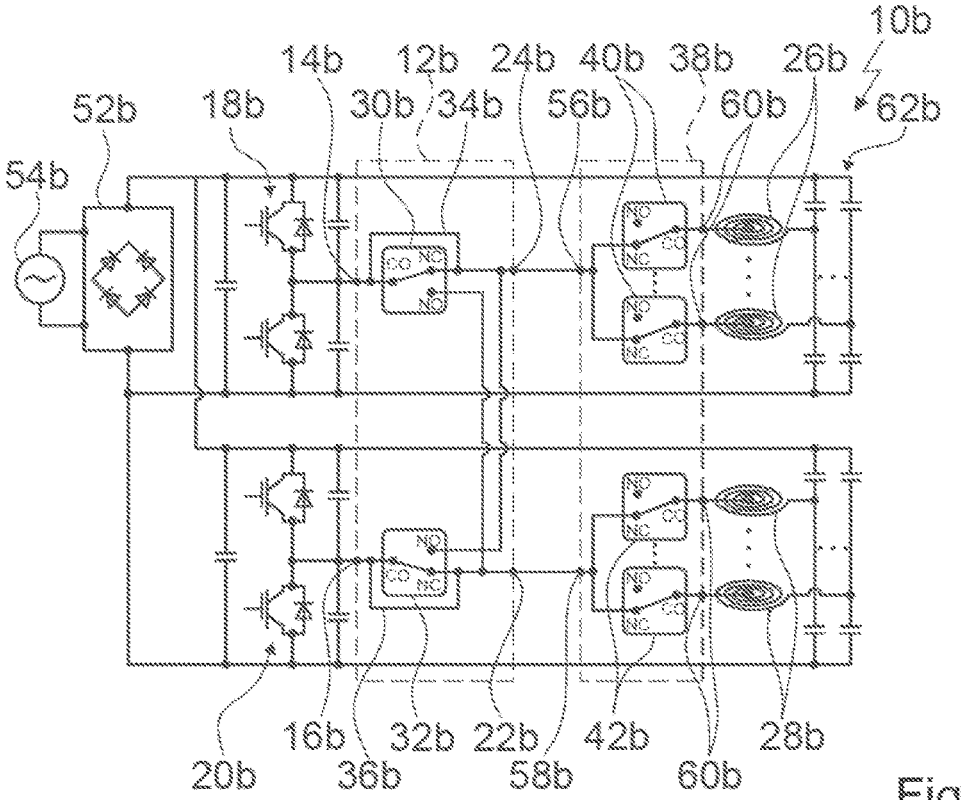
FIG. 8 shows a further modified hob apparatus in a schematic illustration.

A switch 30*b* of the hob apparatus 10*b* is connected to a first input connection 14*b* of the input connections 14*b*, 16*b* and the first output connection 22*b*. A "normally opened" contact of the switch 30*a* is connected to the first output connection 22*b*. The switch 30*b* is additionally connected to the second output connection 24*b*. A "normally closed" contact of the switch 30*b* is connected to the second output connection 22*b*. For example, the configuration unit could have exactly the one switch (cf. FIG. 6), wherein further switches, in particular a second switch, could be dispensed with. Preferably however the configuration unit 12*b* has a second switch 32*b* (cf. FIG. 5), which is connected to the second input connection 16*b* and the second output connection 24*b*. A "normally opened" contact of the second switch 32*b* is connected to the second output connection 24*b*. The second switch 32*b* is additionally connected to the first output connection 22*b*. A "normally closed" contact of the second switch 32*a* is connected to the first output connection 22*b*. As shown in FIG. 7, the configuration unit could have exactly the one second switch, wherein the switch could be dispensed with.

The configuration unit 12*b* has a bridging element 34*b*, which connects the first input connection 14*b* and the second output connection 24*b* to one another independently of a switching position of the switches 30*b*, 32*b*. In this case the bridging element 34*b* bridges the "normally closed" contact of the switch 30*b*. The configuration unit 12*b* has a second bridging element 36*b*, which connects the second input connection 16*b* and the first output connection 22*b* to one another independently of a switching position of the switches 30*b*, 32*b*. The second bridging element 34*b* bridges the "normally closed" contact of the second switch 32*b*.

A switching unit 38*b* of the hob apparatus 10*b* is switched between the configuration unit 12*b* and the heating elements 26*b*, 28*b* and has a plurality of further switches 40*b*, 42*b*. The respective further switches 40*b*, 42*b* are intended to connect one of the heating elements 26*b*, 28*b* individually to the configuration unit 12*b*. The further switches 40*b*, 42*b* are designed as changeover switches (cf. FIG. 5). The further switches 30*b*, 32*b* are designed as relays. Each further switch 40*b*, 42*b* has a "changeover" contact, a "normally opened" contact and a "normally closed" contact. In the present exemplary embodiment the "changeover" contact of the further switches 40*b*, 42*b* is in each case disposed on a side of the further switches 40*b*, 42*b* facing away from the configuration unit 12*b*. Each "changeover" contact of the further switches 40*b*, 42*b* is connected to one of the heating elements 26*b*, 28*b*. Each further switch 40*b*, 42*b* is connected to the configuration unit 12*b* via the "normally opened" contact. Alternatively it is conceivable for each further switch 40*b*, 42*b* to be connected to the configuration unit 12*b* via the "normally closed" contact—as shown for example in FIG. 8.

Figure 9:
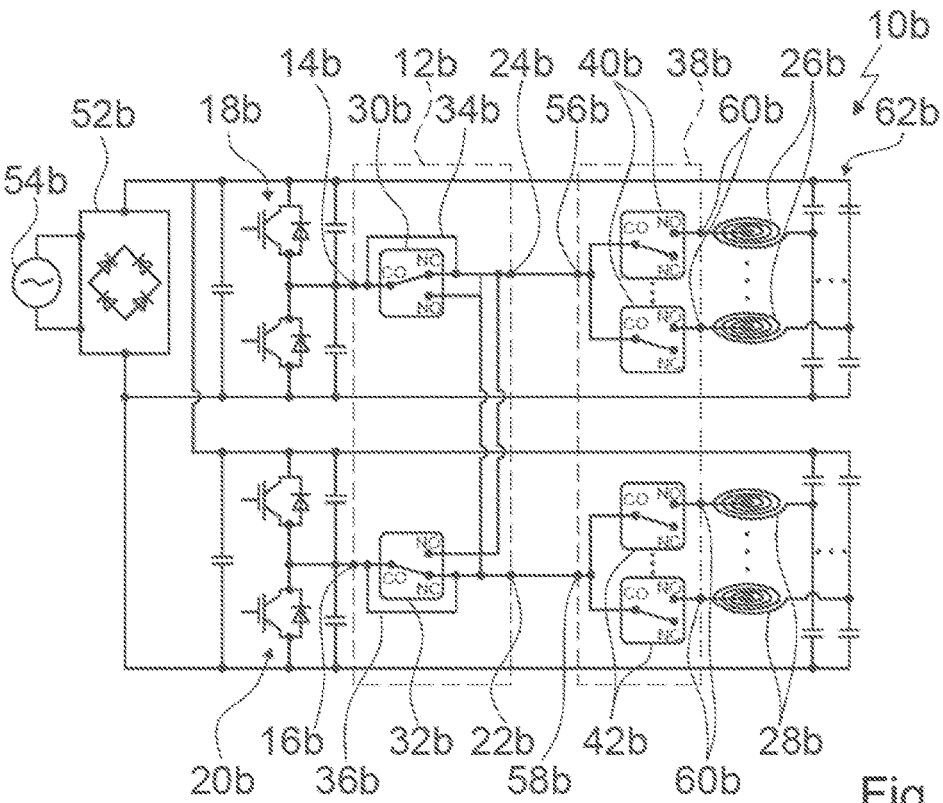
FIG. 9 shows an alternative modified hob apparatus in a schematic illustration.
Figure 10:
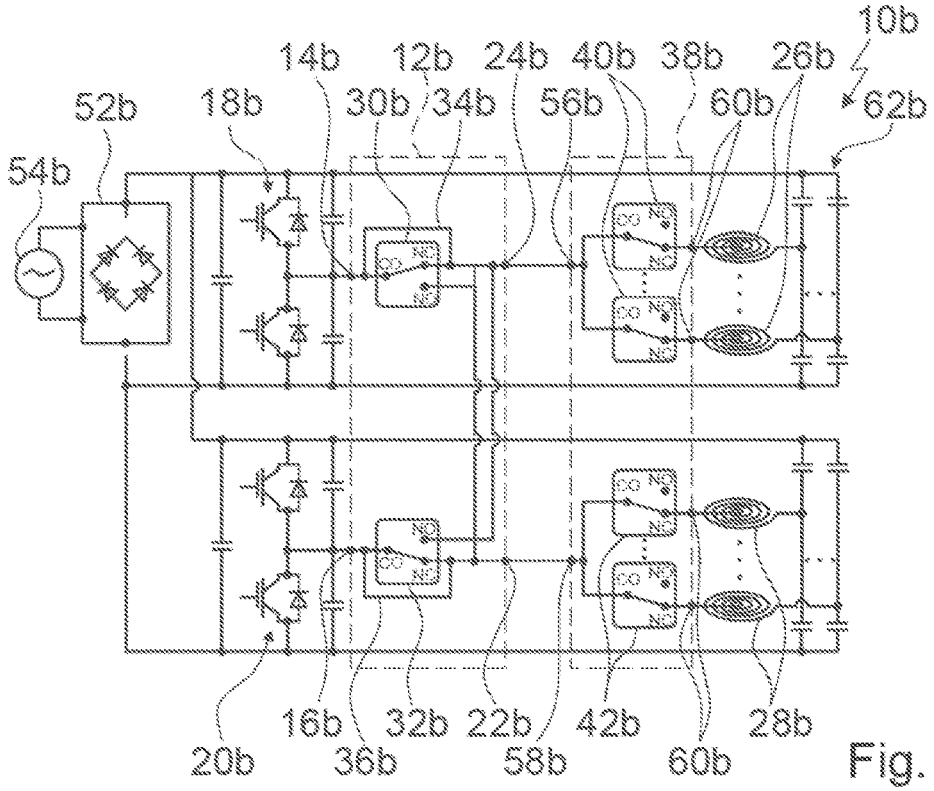
FIG. 10 shows a further alternative modified hob apparatus in a schematic illustration.

In further alternative arrangements of the further switches 40*b*, 42*b* it is conceivable for the "changeover" contact of the further switches 40*b*, 42*b* to be connected to the configuration unit 12*b* (cf. FIGS. 9 and 10). In this case each further switch 40*b*, 42*b* could be connected to one of the heating elements 26*b*, 28*b* via the "normally opened" contact (cf. FIG. 9). As illustrated in FIG. 10, each further switch 40*b*, 42*b* could however also be connected to one of the heating elements 26*b*, 28*b* via the "normally closed" contact.

Figure 11:
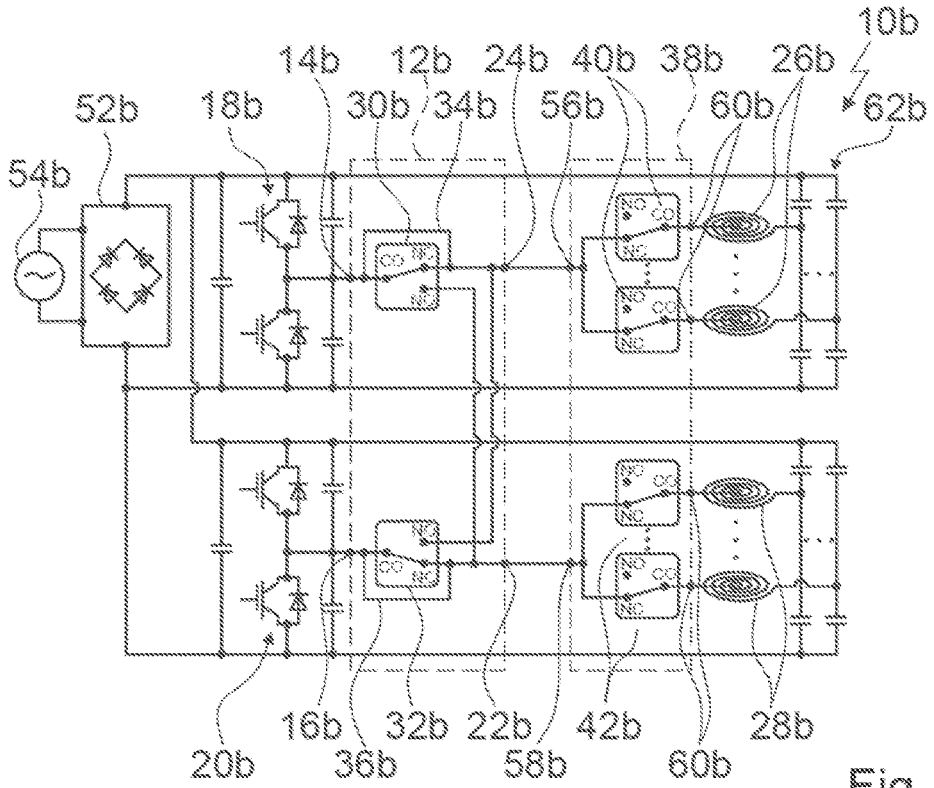
FIG. 11 shows a further alternative hob apparatus in a schematic illustration.
Figure 12:
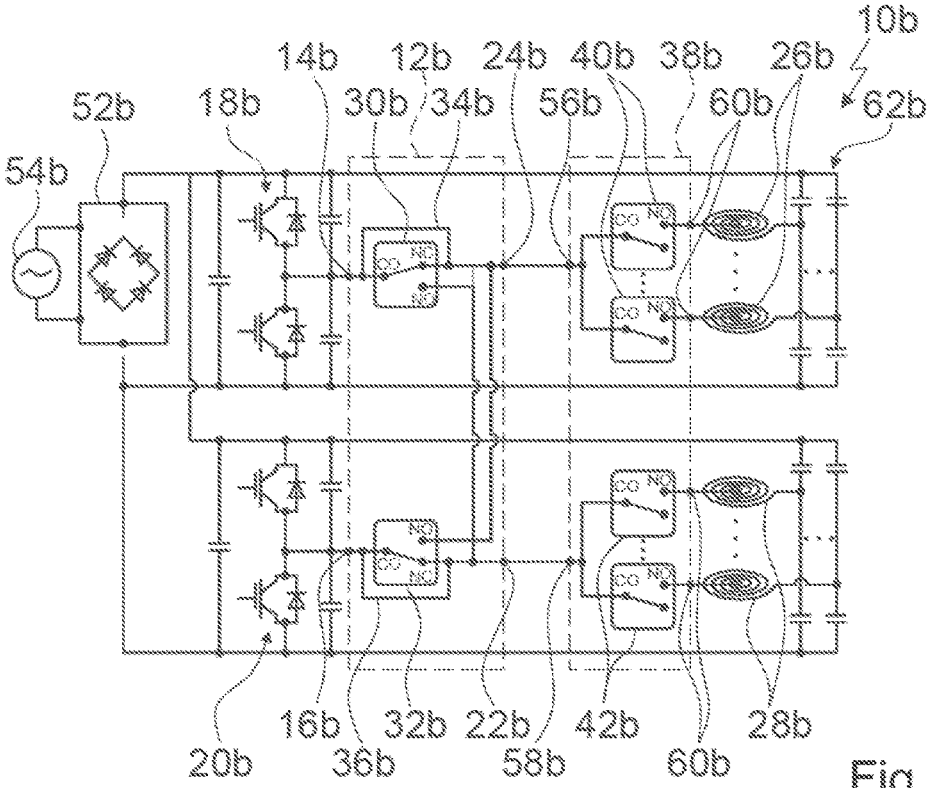
FIG. 12 shows a further modified hob apparatus in a schematic illustration and FIG. 13 shows an alternative modified hob apparatus in a schematic illustration.

Alternatively to an embodiment of the further switches 40*b*, 42*b* as changeover switches it is conceivable for the further switches 40*b*, 42*b* to be designed as on-off switches (cf. FIGS. 11 and 12). In this case each further switch 40*b*, 42*b* could have a "changeover" contact and a "normally opened" contact. Likewise conceivable is for each further switch 40*b*, 42*b* to have a "changeover" contact and a "normally closed" contact (not illustrated). As shown in FIG. 11, each further switch 40*b*, 42*b* could be connected to the configuration unit 12*b* via the "normally opened" contact. In this case each further switch 40*b*, 42*b* would be connected to one of the heating elements 26*b*, 28*b* via the "changeover" contact. Alternatively to this, each further switch 40*b*, 42*b* could be connected to one of the heating elements 26*b*, 28*b* via the "normally opened" contact (cf. FIG. 12). In this case each further switch 40*b*, 42*b* could be connected to the configuration unit 12*b* via the "changeover" contact.

It is furthermore conceivable for a switching position of the configuration unit 12*b* and a switching position of the switching unit 38*b* to be coupled to one another. This can be explained by using FIG. 5 as an example. For example, a switching position of the "normally closed" contacts of the further switches 40*a*, 42*a* could be coupled to a switching position of the "normally opened" contacts of the switches 30*b*, 32*b* of the configuration unit 12*b*. In this case, in the event that the "changeover" contact and the "normally opened" contact of the switch 30*a* are connected to one another, for each further switch 40*a* of the first group the "changeover" contact is connected to the "normally closed" contact. In the present exemplary embodiment the configuration unit 12*b* and the switching unit 38*b* are however designed independently of one another. In particular switching positions of the configuration unit 12*b* and switching positions of the switching unit 38*b* can be set independently of one another.

By means of the switches 30*b*, 32*b* the configuration unit 12*b* is intended in a operating state to operate the inverters 18*b*, 20*b* in parallel to a group of the heating elements 26*b*, 28*b*. In this case it is conceivable for the configuration unit 12*b* in the operating mode to operate the inverters 18*b*, 20*b* in parallel to exactly one heating element 26*b*, 28*b* of a group of the heating elements 26*b*, 28*b*. Alternatively the configuration unit 12*b* in the operating mode could operate the inverters 18*b*, 20*b* in parallel to a plurality of and/or all heating elements 26*b*, 28*b* of a group of the heating elements 26*b*, 28*b*. Furthermore it is conceivable for the configuration unit 12*b* in a further operating mode to operate each of the inverters 18*b*, 20*b* at one of the group of heating elements 26*b*, 28*b*, wherein a majority and advantageously all heating elements 26*b*, 28*b* are in operation jointly.

Figure 13:
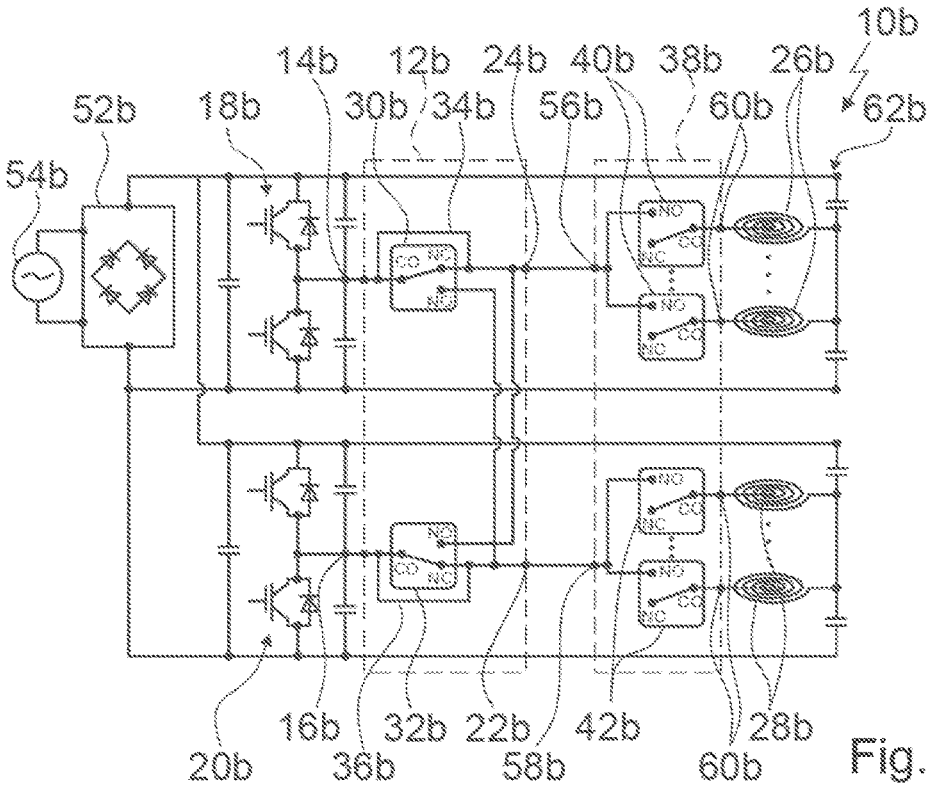

The hob apparatus 10*b* comprises a plurality of resonance capacitors 62*b*. Each resonance capacitor 62*b* has capacitors. Alternatively, embodiments having a different number of capacitors are conceivable. Each resonance capacitor 62*b* is associated with one of the heating elements 26*b*, 28*b*, wherein a number of resonance capacitors 62*b* is substantially identical to a number of heating elements 26*b*, 28*b*. As illustrated in FIG. 13, it is alternatively conceivable for the hob apparatus 10*b* to have exactly one resonance capacitor 62*b* per group of heating elements 26*b*, 28*b*. In this case the hob apparatus 10*b* could in particular have two resonance capacitors 62*b*, which could each be associated with a group of heating elements 26*b*, 28*b*.

Alternatively to an embodiment having two inverters, embodiments having another number of inverters are possible, in particular having more than two inverters, which could each be connected to the rectifier. In this case a number of switches of the configuration unit would be appropriately adjusted, wherein in particular an algorithm could be used for calculating a minimum required number of switches.

The invention claimed is:

1. A hob apparatus, comprising at least one configuration unit including at least two input connections adapted for connection to at least two inverters in one-to-one correspondence, at least two output connections adapted for connection to at least two heating elements in one-to-one correspondence, and at least one switch operably connected to a first one of the at least two input connections and operably connected to at least a first one of the at least two output connections, said at least one configuration unit being configured to operate the at least two inverters in at least one operating state in parallel to at least one of the at least two heating elements, said at least one configuration unit including at least one bridging element configured to connect the first one of the at least two input connections and a second one of the at least two output connections to one another independently of a switching position of the at least one switch.

2. The hob apparatus of claim 1, constructed in the form of an induction hob.

3. The hob apparatus of claim 1, wherein the at least one switch is connected to the second one of the at least two output connections.

4. The hob apparatus of claim 1, wherein the at least one bridging element is configured to bridge a "normally closed" contact of the at least one switch.

5. The hob apparatus of claim 1, wherein the at least one configuration unit includes at least one second switch which is connected to a second one of the at least two input connections and at least to the second one of the at least two output connections.

6. The hob apparatus of claim 5, wherein the at least one second switch is additionally connected to the first one of the at least two output connections.

7. The hob apparatus of claim 1, wherein the at least one configuration unit includes at least one second bridging element which is configured to connect a second one of the at least two input connections and the first one of the at least two output connections to one another.

8. The hob apparatus of claim 7, wherein the at least one configuration unit includes at least one second switch which is connected to a second one of the at least two input connections and at least to the second one of the at least two output connections, said at least one second bridging element being configured to bridge a "normally closed" contact of the at least one second switch.

9. The hob apparatus of claim 1, further comprising a switching unit switched between the at least one configuration unit and the at least two heating elements.

10. The hob apparatus of claim 9, wherein the switching unit includes at least two further switches, each of the least two further switches being configured to connect one of the at least two heating elements individually to the configuration unit.

11. A hob, comprising at least one hob apparatus which includes at least one configuration unit including at least two input connections adapted for connection to at least two inverters in one-to-one correspondence, at least two output connections adapted for connection to at least two heating elements in one-to-one correspondence, and at least one switch operably connected to a first one of the at least two input connections and operably connected to at least a first one of the at least two output connections, said at least one configuration unit being configured to operate the at least two inverters in at least one operating state in parallel to at least one of the at least two heating elements, said at least one configuration unit including at least one bridging element configured to connect the first one of the at least two input connections and a second one of the at least two output connections to one another independently of a switching position of the at least one switch.

12. The hob of claim 11, wherein the hob apparatus is constructed in the form of an induction hob.

13. The hob of claim 11, wherein the at least one switch is connected to the second one of the at least two output connections.

14. The hob of claim 11, wherein the at least one bridging element is configured to bridge a "normally closed" contact of the at least one switch.

15. The hob of claim 11, wherein the at least one configuration unit includes at least one second switch which is connected to a second one of the at least two input connections and at least to the second one of the at least two output connections.

16. The hob of claim 15, wherein the at least one second switch is additionally connected to the first one of the at least two output connections.

17. The hob of claim 11, wherein the at least one configuration unit includes at least one second bridging element which is configured to connect a second one of the at least two input connections and the first one of the at least two output connections to one another.

18. The hob of claim 17, wherein the at least one configuration unit includes at least one second switch which is connected to a second one of the at least two input connections and at least to the second one of the at least two output connections, said at least one second bridging element being configured to bridge a "normally closed" contact of the at least one second switch.

19. The hob of claim 11, wherein the hob apparatus includes a switching unit switched between the at least one configuration unit and the at least two heating elements.

20. The hob of claim 19, wherein the switching unit includes at least two further switches, each of the least two further switches being configured to connect one of the at least two heating elements individually to the configuration unit.

* * * * *